United States Patent [19]

Bartok, Jr.

[11] Patent Number: 4,744,273

[45] Date of Patent: May 17, 1988

[54] FASTENER RETAINING ATTACHMENT FOR WRENCH SOCKETS

[76] Inventor: William P. Bartok, Jr., 6423 Meldon Dr., Mentor, Ohio 44060

[21] Appl. No.: 59,564

[22] Filed: Jun. 8, 1987

Related U.S. Application Data

[63] Continuation-in-part of Ser. No. 894,939, Aug. 8, 1986, abandoned, which is a continuation-in-part of Ser. No. 752,820, Jul. 8, 1985, abandoned.

[51] Int. Cl.[4] ..... B25B 23/08

[52] U.S. Cl. ..... 81/453; 81/125; 81/458

[58] Field of Search ..... 81/125, 451, 452, 453, 81/454, 455, 456, 458

[56] References Cited

U.S. PATENT DOCUMENTS

| | | | |
|---|---|---|---|
| 1,127,236 | 2/1915 | Harbridge | 81/451 |
| 1,712,196 | 5/1929 | Borger et al. | 81/451 |
| 2,704,954 | 3/1955 | Martorella | 81/125 |

*Primary Examiner*—Frederick R. Schmidt
*Assistant Examiner*—Maurina Rachuba
*Attorney, Agent, or Firm*—Body, Vickers & Daniels

[57] ABSTRACT

A generally U-shaped attachment of resilient sheet metal is adapted to be axially captured relative to the drive shank and wrench socket of a socket wrench assembly so as to extend along opposite sides of the socket and then inwardly of the fastener receiving opening in the wrench socket to releaseably retain the head of the fastener therein during application or removal of the fastener from a mating part. The inwardly extending portions of the attachment provide cam surfaces which facilitate reception, retention and removal of a fastener head from the wrench socket opening.

23 Claims, 3 Drawing Sheets

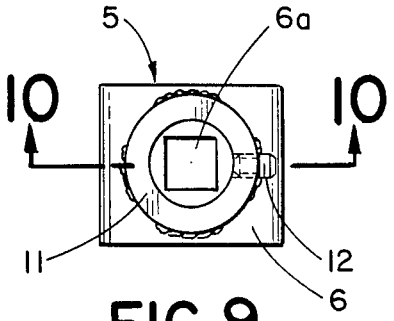
FIG. 9
FIG. 10
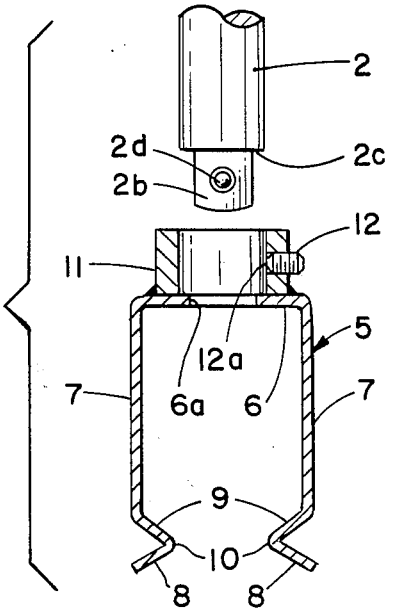
FIG. 11
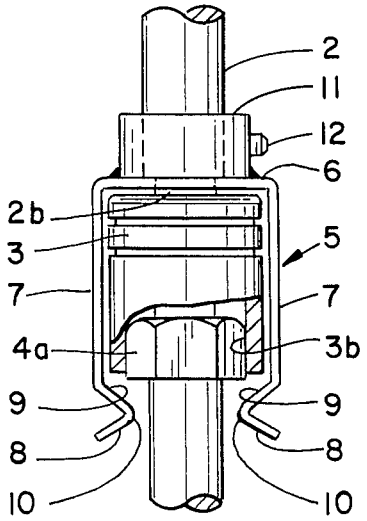

FASTENER RETAINING ATTACHMENT FOR WRENCH SOCKETS

This application is a continuation-in-part of application Ser. No. 894,939 filed August 8, 1986, now abandoned and which in turn is a contination-in-part of application Ser. No. 752,820 filed July 8, 1985, now abandoned.

BACKGROUND OF THE INVENTION

This invention relates to the art of socket wrenches and, more particularly, to an attachment for use with such wrenches for retaining a threaded fastener component in the wrench socket during screwing or unscrewing of the fastener component relative to a mating part.

It is of course well known that socket wrenches are comprised of an operating handle having a square shank on one end thereof to which various sizes of wrench sockets are detachably mounted to enable rotation of the wrench socket to achieve the screwing or unscrewing of a threaded fastener component such as a headed bolt or nut from its mating part. It is likewise well known that the operating handle often has a reversible, ratchet-type driving engagement with the square shank, and that the wrench socket may be interengaged with the shank through an extension rod having one end contoured to detachably interengage with the square shank and having a square shank on the opposite end thereof for detachably receiving the wrench socket. It is further well known that such detachable connections are achieved through a spring biased ball on the shank and a ball receiving recess in the wrench socket.

Frequently, the user of such a socket wrench must introduce or remove a threaded fastener component from an area which is not accessible to the user's hands or from an area which would be potentially dangerous if the user's hands were to come in contact therewith, such as a hot area in the engine compartment of an automobile. Efforts to introduce or remove a bolt or nut from such an inaccessible or potentially dangerous location can be very frustrating in that the user may not be able to position a finger or fingers of one hand at the location of the bolt or nut so as to maintain the latter in engagement with the socket. Accordingly, it becomes advantageous to capture the threaded fastener component relative to the wrench socket during application or withdrawal of the component from mating relationship with its companion part.

Previous efforts to provide for retention of a fastener component relative to a wrench socket during installation or removal of the fastener component have been disadvantageous for a number of reasons. For example, certain efforts have required at least a portion of the fastener retainer to occupy space within the wrench socket, and such either affects the dimensions within the socket relative to the size of the fastener component receivable therein and/or can interfere with and make difficult the introduction of the fastener component into the socket opening. The latter is especially true when attempting to introduce the socket over the head of a bolt or over a nut which is not visible to the user, thus requiring rotative manipulation of the socket relative to the fastener to achieve reception of the fastener component in the socket opening. Moreover, such previous retainers are subjected to sliding frictional interengagement with a fastener component each time the socket is used and, accordingly, are subjected to excessive wear which can quickly reduce the ability of the retainer to perform its function. Additionally, retainer attachments heretofore available often can be unintentionally displaced from the wrench socket during use. Moreover, such prior efforts have been expensive either as a result of requiring a specially constructed wrench socket or a complexly constructed attachment for the socket, and in necessitating a retainer for each and every different wrench socket size.

SUMMARY OF THE INVENTION

In accordance with the present invention, a fastener retaining attachment is provided for use with socket wrenches which advantageously overcomes the foregoing and other disadvantages attendant to the retaining arrangements heretofore provided. More particularly in accordance with the present invention, a generally U-shaped fastener retainer is removably received between a socket wrench drive shank and wrench socket and is captured therebetween against axial displacement relative to the shank and socket. The retainer includes a bridging portion for the latter purpose which extends across the shank receiving end of the socket and a pair of diametrically opposed legs extending from the bridging portion along opposite sides of the socket to the fastener receiving end thereof. The retainer is constructed from resilient material, whereby the legs are adapted to be flexed radially outwardly and inwardly relative to the socket, and the lower ends of the legs are provided with camming surfaces extending radially inwardly below the fastener receiving end of the socket so as to be spaced apart a distance less than the dimension across the socket opening. Accordingly, when the socket is moved axially to receive a fastener head or nut therein, the bridging portion abuts against a surface adjacent the shank to axially position the attachment, and the camming surfaces engage the fastener head or nut and are flexed radially outwardly to permit movement of the fastener into the socket. When the head or nut moves past the camming surfaces, the legs flex radially inwardly for the camming surfaces to engage under the fastener head or nut and retain the latter in the socket. Following introduction or removal of the fastener component from threaded engagement with its mating part, separation of the fastener component from the socket is achieved by relative axial displacement between the socket and fastener during which the bridging portion engages against the mounting end of the socket and the camming surfaces engage the underside of the head or nut and are flexed radially outwardly to permit such separation. The attachment is readily assembled with or separable from the wrench handle and socket simply by removing the socket from the mounting shank and introducing or removing the attachment from the shank. Thus, use of the attachment is selective. In order to enable use of the attachment with a socket wrench set in which the spring biased ball is worn or the spring weakened to the extent that the resistance of the legs to flexing exceeds the holding force of the spring biased ball and recess engagement, the bridging portion of the attachment can be provided with a collar or the like which enables fastening the attachment against displacement from the shank.

It is accordingly an outstanding object of the present invention to provide an improved attachment for use with socket wrenches to releaseably retain a threaded fastener component in a wrench socket during application or removal of the component from engagement with a companion part.

Another object is the provision of an attachment of the foregoing character having improved ease and efficiency in operation with respect to engaging with and retaining a fastener component to be introduced or removed from an inaccessible location.

Still another object is the provision of an attachment of the foregoing character which is relatively inexpensive to manufacture, durable in use and subject to minimum frictional interengagement with fastener components during use, thus to promote the life of the attachment.

Still a further object is the provision of an attachment of the foregoing character which is easily attached to or removed from socket wrench components and which, when attached thereto, is securely interengaged with the wrench socket and socket mounting shank against axial displacement relative thereto, thus to assure appropriate positioning of the attachment relative to the socket in connection with engaging and holding a fastener component in the socket during application or removal of the component.

Still another object is the provision of an attachment of the foregoing character comprised of resilient material and including resilient fingers having cam surfaces to facilitate displacement of the fastener component into and out of a wrench socket opening by radially outward displacement of the resilient fingers and to facilitate retention of the fastener component in the wrench socket by displacement of the cam surfaces radially inwardly thereof by the resilient fingers of the attachment following such insertion.

Yet another object is the provision of an attachment of the foregoing character which includes a bridging portion from which the resilient legs depend and which bridging portion and thus the attachement is adapted to be detachably secured against removal from the socket mounting shank upon separation of the wrench socket therefrom.

BRIEF DESCRIPTION OF THE DRAWING

The foregoing objects, and others, will in part be obvious and in part pointed out more fully hereinafter in conjunction with the written description of a preferred embodiment of the accompanying drawings in which:

FIG. 9 is a top view of a modification of the attachment shown in FIGS. 1–8;

FIG. 10 is a cross-sectional elevation view of the modified attachment taken along line 10—10 in FIG. 9 and showing a tool shank on which the attachment is mountable; and, FIG. 11 is an elevation view similar to FIG. 8 and showing the modified attachment in assembled relationship with a wrench socket and headed fastener.

DESCRIPTION OF A PREFERRED EMBODIMENT

Figures 1, 2:
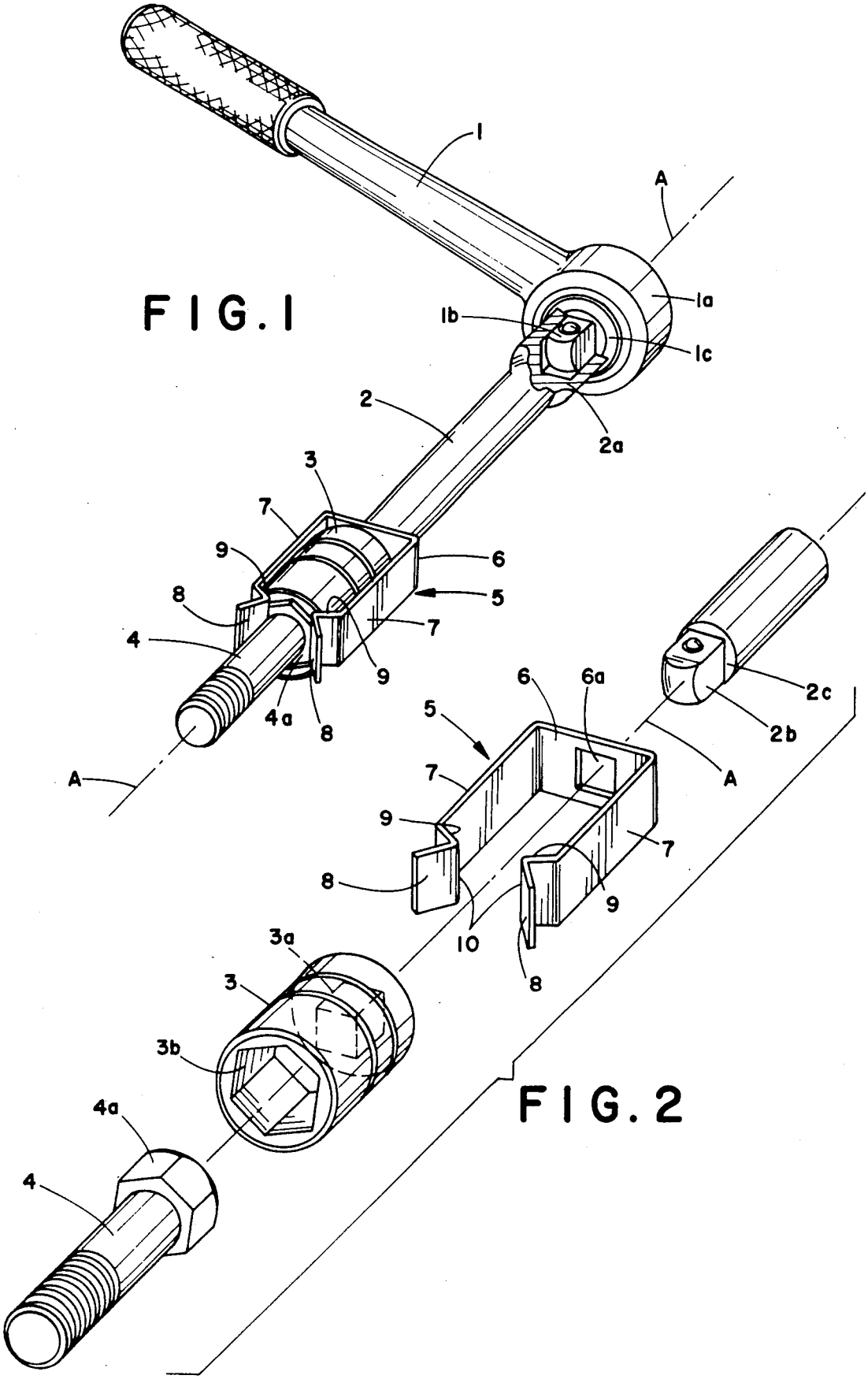
FIG. 1 is a perspective view of a socket wrench assembly having an attachment according to the present invention mounted thereon.
FIG. 2 is an exploded perspective view of certain of the component parts shown in FIG. 1.
Figure 3:
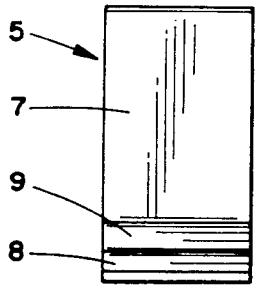
FIG. 3 is a side elevation view of an attachment according to the present invention.
Figure 4:
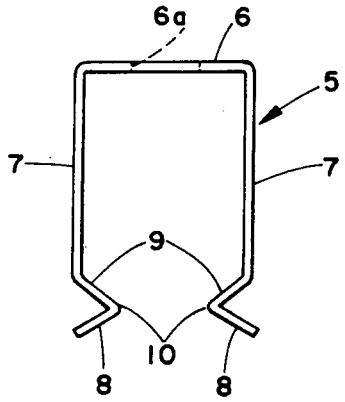
FIG. 4 is an end elevation view of the attachment shown in FIG. 3.
Figure 5:
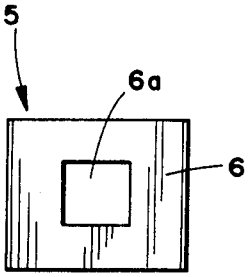
FIG. 5 is a top plan view of the attachment shown in FIG.3.

With reference now in greater detail to the drawings, wherein the showings are for the purpose of illustrating a preferred embodiment of the invention only, and not for the purpose of limiting the invention, FIGS. 1–5 illustrate an attachment according to the present invention and the assembly thereof with a wrench operating handle and wrench socket. More particularly, wrench handle 1 is shown as being that of the character having a head portion 1*a* and a square mounting shank 1*b* which, through a well known reversible ratchet mechanism in head 1*a*,is adapted to be coupled with handle 1 so as to be rotated thereby selectively in opposite directions about the axis A of shank 1*b*. As is further well known, drive shank 1*b* is adapted to receive the mounting end of a coaxial wrench socket 3 directly thereon or, as shown in FIGS. 1 and 2, indirectly thereon through the use of a coaxial extension rod 2 having one end 2*a* provided with a recess to receive shank 1*b* and having a square shank 2*b* on its other end corresponding to shank 1*b*. The mounting end of the wrench socket has a shank receiving recess 3*a* for receiving either shank 1*a* or 1*b* to releaseably interengage wrench socket 3 with the wrench handle.

The recess in end 2*a* of extension rod 2 and the shank receiving recess 3*a* in the mounting end of wrench socket 3 are of a square contour corresponding to that of shanks 1*b* and 2*b*so that, when releaseably interengaged with one or the other of the shanks 1*b* and 2*b*, socket 3 is rotatably displaceable therewith. Head 1*a* has an end face 1*c* extending about shank 1*b*, and extension rod 2 is circular in cross-section, whereby a shoulder 2*c* is defined by providing the end of the extension rod with the square shank 2*b*. End face 1*c* and shoulder 2*c* provide abutment surfaces for the purpose set forth hereinafter. Finally, as is also well known, the opposite end of wrench socket 3 has a fastener receiving opening 3*b* which is multiple faceted for driving engagement with multi-sided fastener components such as the hexagonal head 4*a* of a bolt 4. While a bolt is illustrated in the drawing, it will be appreciated that the fastener component can be a nut, the head of a lag screw, or the like.

The fastener retaining attachment according to the present invention, which is designated generally by the numeral 5 in the drawing, is produced of a strip of resilient material which, preferably, is of a suitable metal such as spring steel, although other metals or even suitable plastic materials could be used. The attachment is generally U-shaped in configuration and comprises a bridging portion 6 which extends transverse to axis A and has an opening 6*a* axially therethrough. Bridging portion 6 has laterally opposite ends, not designated numerically, and the fastener retaining attachment further includes a pair of fingers 7 integral with and extending axially in the same direction from the opposite ends of the bridging portion. The ends of fingers 7 spaced from bridging portion 6 are provided with corresponding camming surfaces projecting radially inwardly from fingers 7 and, in the embodiment illustrated, such camming surfaces are defined by portions 9 integral with the ends of fingers 7 and inclined radially inwardly and axially away from bridging portion 6, and portions 8 integral with portions 9 and inclined radially outwardly and axially away from bridging portion 6. Bridging portions 8 and 9 associated with each of the fingers 7 have a corresponding line of juncture 10 therebetween, and fingers 7 have a length between bridging portion 6 and camming portions 9 corresponding generally to the length of wrench socket 3 whereby, when attachment 5 is secured in place, the camming projections extend radially inwardly below the fastener receiving opening 3*b* sufficiently to engage under head 4*a* of fastener 4 when the latter is received in opening 3*b*. Opening 6*a* in bridging portion 6 is adapted to receive one or the other of the mounting shanks 1*b* or 2*b* depending on which of the shanks wrench socket 3 is to be mounted. Preferably, opening 6*a* is of square contour so as to be supported on the mounting shanks against rotation relative thereto, although the latter is not essential in accordance with the present invention. In any event, when bridging portion 6 is received on shank 1*b* or 2*b*, the bridging portion abuts against the corresponding one of end face 1*c* of ratchet head 1*a* or shoulder 2*c* of extension rod 2 so as to be axially captured between the end face or shoulder and the adjacent end face of the mounting end of wrench socket 3 when the latter is mounted on shank 1*b* or 2*b*. Such axial capturing of the attachment is important, as will become apparent hereinafter.

Figure 6:
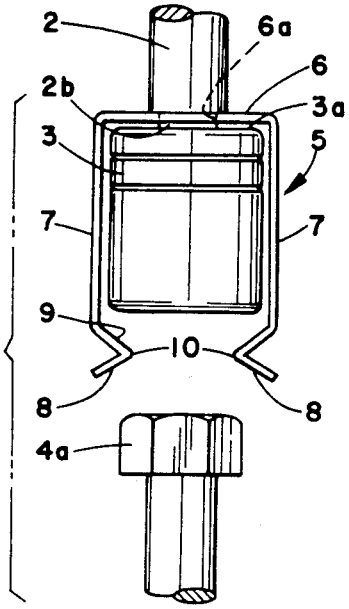
FIGS. 6–8 are elevation views showing operation of the attachment during introduction of a headed fastener into a wrench socket opening.
Figure 7:
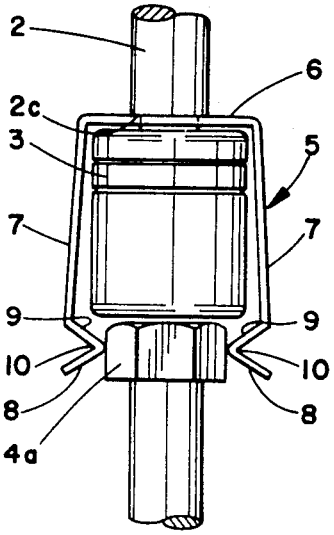
Figure 8:
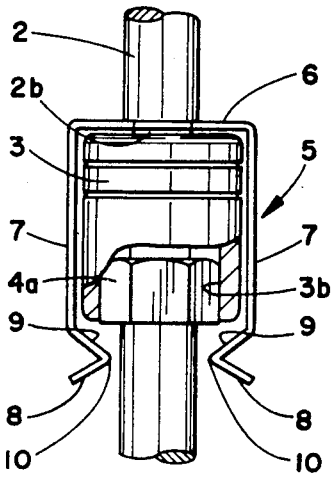

When attachment 5 is assembled with the extension rod and wrench socket, as shown in FIG. 6, displacement of the assembly axially towards head 4*a* of fastener 4 results in the upper outer edge of head 4*a* engaging camming portions 8 whereupon bridging portion 6 abuts against shoulder 2*c* to axially position the attachment so as to enable radial outward flexure of fingers 7 by head 4*a* as shown in FIG. 7. Continued axial displacement of the assembly toward engagement with fastener 4 results in head 4*a* moving into opening 3*b* in the wrench socket and past edges 10 of the camming projections, whereupon resilient fingers 7 return radially inwardly to their original positions in which the camming projections underlie fastener head 4*a* as shown in FIG. 8. If, for example, such engagement of the mounted attachment is with respect to a fastener 4 to be removed from threaded engagement with a mating part, it will be appreciated that rotation of wrench socket 3 through the wrench handle results in rotation of fastener 4 in the direction to release the latter from threaded engagement with its mating part. Thereafter, axial withdrawal of the assembly results in the underside of fastener head 4*a* engaging camming portions 9 on fingers 7, whereby the fastener is retained in engagement with wrench socket 3 until physically removed therefrom by pulling the fastener 4 axially outwardly from socket opening 3*b*. Such pulling of the fastener results in the underside of head 4*a* engaging against cam portions 9, whereupon bridging portion 6 engages against the end face of the mounting end of the socket to axially position the attachment so as to enable radial outward flexure of fingers 7 by head 4*a*, as will be appreciated from FIG. 7, and removal of fastener head 4*a* from the wrench socket. It will be appreciated of course that the separation of wrench socket 3 and fastener head 4*a* is similarly achieved following the screwing of fastener 4 into engagement with its mating part. It will be appreciated too that the radially outward camming of resilient fingers 7 during both insertion and removal of a fastener component relative to socket opening 3*b* is assured by the axial capturing of the bridging portion 6 between the wrench socket and either end face 1*c* of the wrench handle or shoulder 2*c* of the extension rod. In connection with engaging wrench socket 3 with the head of a fastener to be removed, it will be appreciated that the camming of the fingers 7 radially outwardly during introduction of the socket onto the fastener head enables easy rotative manipulation of the socket through the wrench handle into appropriate alignment with the fastener head to achieve reception of the head in the wrench socket opening 3*b* free of any internal interference between the socket opening and fastener head.

Referring now to FIGS. 9–11 of the drawing, there is shown a modification of the attachment described hereinabove and which advantageously provides a selectively usable arrangement for securing the attachment relative to the shank portion 2*b* of an extension rod 2. As is well known in connection with socket wrenches, after prolonged use and the attachment and detachment of wrench sockets relative to shank portion 2*b*, retaining ball 2*d* becomes worn and/or its biasing spring weakens, whereby the retention capability thereof with respect to a wrench socket is progressively reduced. As will be appreciated from FIG. 8 of the drawing, if the axial force required to overcome the resilient bias of fingers 7 of the attachment upon upward movement of the tool and attachment assembly relative to bolt head 4*a* is greater than the retention force between shank 2*b* and wrench socket 3, shank 2*b* will separate from wrench socket 3 leaving the latter and attachment 5 on the bolt head. Such a possibility can exist when ball 2*d* is worn and/or its biasing spring is weakened from extensive use.

In order to enable continued use of attachment 5 under the foregoing circumstances, a collar or sleeve 11 can be welded or otherwise secured to bridging portion 6. Sleeve 11 is coaxial with opening 6*a* through the bridging portion and has an inner diameter enabling the sleeve to slidably receive the circular portion of extension rod 2 axially adjacent shoulder 2*c*. Sleeve 11 is provided with a threaded opening radially therethrough for receiving a set screw or the like 12 having an inner end 12*a* adapted to be screwed into interengagement with the outer surface of rod 2 when the attachment is assembled thereon as shown in FIG. 11. It will be appreciated of course that if sleeve 11 is mounted on the attachment at the time of manufacture thereof, the set screw need only be displaced into engagement with rod 2 when the attachment is used with a tool assembly in which the foregoing separation problem is experienced. At the same time, however, it will be appreciated that the attachment can be so secured to rod 2 against axial displacement relative thereto even when the attachment is used in connection with a tool assembly wherein the ball detent force is sufficient to overcome the resilient bias of the attachment fingers 7.

While the embodiments illustrated in FIGS. 1–11 show a wrench socket 3 having a diameter generally corresponding to the length of bridging portion 6 and thus the spacing between fingers 7, it will be readily appreciated that the basic configuration of attachment 5 can provide for a single attachment to accommodate a number of different size wrench sockets. In this respect, in a given set of wrench sockets of varying size with respect to fastener receiving opening 3*b*, a number of the sockets will be of the same axial length and varying outside diameter. Thus, as will be appreciated from FIGS. 6–8, wrench sockets having the same axial length as wrench socket 3 but of smaller diameter than the latter could be used with attachment 5 and the latter would be operable to retain the smaller size fastener head in the wrench socket opening, provided the distance between cam edges 10 is small enough for the camming surfaces to engage under the smaller fastener head. This relationship can be achieved, for example, by extending the radially inward projection of the camming portions 8 and 9 to provide such spacing between edges 10 thereof. Such adaptation of the attachment to accommodate a number of different size wrench sockets can likewise be achieved by inclining fingers 7 in converging relationship in the direction from bridging portion 6 toward the camming portions, again for the space between cam edges 10 to be small enough for the camming surfaces to engage under the head of the smallest fastener to be accommodated in a given wrench socket. With this arrangement, the maximum diameter wrench socket would correspond to the length of bridging portion 6 and thus the spacing of fingers 7 at the points of connection to the bridging portion. Further, it will be appreciated that such converging disposition of the fingers would provide for the larger diameter wrench sockets to spread and hold the fingers radially outwardly against the resiliency of the material tending to displace the fingers radially inwardly to such dispositions.

While considerable emphasis has been placed herein on the preferred embodiments illustrated and described above, it will be appreciated that the foregoing and other modifications of the preferred embodiment as well as other embodiments of the attachment can be made without departing from the principals of the invention. In this respect, for example, it will be appreciated that the radially inwardly extending camming projections could be separate from and attached to the resilient fingers and/or could have a round contour as opposed to the pointed, V-shaped contour shown. Further, it will be appreciated that the attachment could be constructed by appropriately bending spring wire to provide the attachment configuration. Still further, in connection with the modification, it will be appreciated that fastening arrangements other than a collar or sleeve and set screw can be provided on the bridging portion to releaseably secure the attachment to the extension rod. These and other embodiments and modifications of the embodiment disclosed herein will be apparent or suggested to those skilled in the art, whereby it is to be distinctly understood that the foregoing descriptive matter is to be interpreted merely as illustrative of the invention and not as a limitation.

Having thus described the invention, it is claimed:

1. An attachment for use with a socket wrench assembly comprising wrench handle means and means including shank means for releaseably mounting a wrench socket on said handle means, said shank means having an axis and being non-circular in cross-section, means providing abutment means adjacent said shank means in the direction toward said handle means and transverse to said axis, and said wrench socket having a mounting end receiving said shank means and facing said abutment means and an opposite end having a multi-faceted opening for receiving a threaded fastener component, said opening having a peripheral edge, said attachment being removably mountable on said shank means and comprising a bridging portion having an opening therethrough receiving said shank means, said bridging portion being axially captured between and engaged by said abutment means and said mounting end of said wrench socket to support said attachment against axial displacement relative thereto and against tilting displacement relative to said axis, said bridging portion extending transverse to said axis and having opposite ends radially spaced from said axis, said attachment further comprising resilient finger means extending axially from said opposite ends of said bridging portion toward said opposite end of said wrench socket, and cam means on said finger means adjacent said opposite end of said wrench socket and projecting radially inwardly across said peripheral edge of said multi-faceted opening to releaseably retain a fastener component in said opening, said bridging portion in being axially captured between said abutment means and said mounting end of said wrench socket positioning said finger means and cam means against axial displacement relative to said shank means and said wrench socket whereby said cam means remains axially fixed relative to said shank means and wrench socket upon axial displacement of a fastener component into and out of said opening and is engaged by the fastener component to displace said cam means and finger means radially outwardly against the resiliency of said finger means to enable said axial displacement of said fastener component into and out of said opening.

2. An attachment according to claim 1, wherein said attachment is constructed from resilient sheet material.

3. An attachment according to claim 1, wherein said opening through said bridging portion and said shank means interengage said attachment with said shank means for displacement therewith about said axis.

4. An attachment according to claim 3, wherein said opening through said bridging portion is generally square.

5. An attachment according to claim 4, wherein said attachment is constructed from resilient sheet material.

6. An attachment according to claim 1, wherein said cam means on each said resilient finger means is generally V-shaped.

7. An attachment according to claim 6, wherein each said cam means is integral with the corresponding finger means.

8. An attachment according to claim 7, wherein said opening through said bridging portion and said shank means interengage said attachment with said shank means for displacement therewith about said axis.

9. An attachment according to claim 8, wherein said opening through said bridging portion is generally square.

10. An attachment according to claim 9, wherein said attachment is constructed from resilient sheet material.

11. An attachment according to claim 1, wherein said resilient finger means extend from said bridging portion parallel to one another.

12. an according to claim 11, wherein said attachment is constructed from resilient sheet material.

13. An attachment according to claim 12, wherein each said cam means is integral with the corresponding finger means.

14. An attachment according to claim 13, wherein said opening through said bridging portion and said shank means interengage said attachment with said shank means for displacement therewith about said axis.

15. An attachment according to claim 14, wherein said opening through said bridging portion is generally square.

16. An attachment according to claim 15, wherein said cam means on each said resilient finger means is generally V-shaped.

17. An attachment according to claim 1, wherein said means including shank means includes circular rod means extending from said abutment means in the direction toward said handle, and means for releaseably securing said bridging portion to said circular rod means to preclude separation of said attachment from said shank means.

18. An attachment according to claim 17, wherein said means for releaseably securing said bridging portion to said rod means includes sleeve means on said bridging portion receiving said rod means, and fastening means releaseably interengaging said sleeve means and said rod means.

19. An attachment according to claim 18, wherein said fastening means includes a threaded fastener extending radially through said sleeve means and having an inner end engaging against said rod means.

20. An attachment for use with a socket wrench assembly comprising wrench handle means and means including shank means for releaseably mounting a wrench socket on said handle means, said shank means having an axis and being non-circular in cross-section, means providing abutment means adjacent said shank means in the direction toward said handle means and transverse to said axis, said means including shank means including circular rod means extending from said abutment means in the direction toward said handle means, said wrench socket having a mounting end receiving said shank means and facing said abutment means and an opposite end having a multi-faceted opening for receiving a threaded fastener component, said opening having a peripheral edge, said attachment being removably mountable on said shank means and comprising a bridging portion having an opening therethrough receiving said shank means, said bridging portion being axially adjacent said abutment means and said mounting end of said wrench socket, means on said bridging portion for releaseably securing said bridging portion to said circular rod means to support said attachment against axial displacement relative thereto and against tilting displacement relative to said axis, said bridging portion extending transverse to said axis and having opposite ends radially spaced from said axis, said attachment further comprising resilient finger means extending axially from said opposite ends of said bridging portion toward said opposite end of said wrench socket, and cam means on said finger means adjacent said opposite end of said wrench socket and projecting radially inwardly across said peripheral edge of said multi-faceted opening to releaseably retain a fastener component in said opening, said bridging portion in being axially captured between adjacent said abutment means and said mounting end of said wrench socket positioning said finger means and cam means against axial displacement relative to said shank means and said wrench socket whereby said cam means remains axially fixed relative to said shank means and wrench socket upon axial displacement of a fastener into and out of said opening and is engaged by the fastener component to displace said cam means and finger means radially outwardly against the resiliency of said finger means to enable said axial displacement of said fastener component into and out of said opening.

21. An attachment according to claim 20, wherein said means including shank means includes circular rod means extending from said abutment means in the direction toward said handle, and means for releaseably securing said bridging portion to said circular rod means to preclude separation of said attachment from said shank means.

22. An attachment according to claim 21, wherein said means for releaseably securing said bridging portion to said rod means includes sleeve means on said bridging portion receiving said rod means, and fastening means releaseably interengaging said sleeve means and said rod means.

23. An attachment according to claim 22, wherein said fastening means includes a threaded fastener extending radially through said sleeve means and having an inner end engaging against said rod means.

* * * * *

UNITED STATES PATENT AND TRADEMARK OFFICE

CERTIFICATE OF CORRECTION

PATENT NO. : 4,744,273

DATED : May 17, 1988

INVENTOR(S) : William P. Bartok, Jr.

It is certified that error appears in the above-identified patent and that said Letters Patent are hereby corrected as shown below:

Title Page, Item [56], U.S. Patent 1,712,196, the inventors should read --- Burger et al. ---. Column 1, line 7, "contination-in-part" should read --- continuation-in-part ---. Column 3, line 38, "attachement" should read --- attachment ---. Column 4, line 17, after "1a," insert a space; line 27, "1a or 1b" should read --- 1b or 2b ---; line 33, after "2b" insert a space ---. Column 8, line 56 (actual), in claim 12, "an" should read --- An attachment ---. Column 10, line 13, "captured between" should be deleted ---.

Signed and Sealed this

Fourth Day of October, 1988

*Attest:*

*Attesting Officer*

DONALD J. QUIGG

*Commissioner of Patents and Trademarks*